US005261869A

United States Patent [19]

Caldwell et al.

[11] Patent Number: 5,261,869

[45] Date of Patent: Nov. 16, 1993

[54] DECANTER CENTRIFUGE HAVING DISCONTINUOUS FLIGHTS IN THE BEACH AREA

[75] Inventors: John W. Caldwell, Glenside; Raymond S. Lemmerman, Southampton, both of Pa.

[73] Assignee: Alfa Laval Separation, Inc., Warminster, Pa.

[21] Appl. No.: 863,995

[22] Filed: Apr. 6, 1992

[51] Int. Cl.[5] ..... B04B 1/20; B04B 3/04

[52] U.S. Cl. ..... 494/54; 494/56

[58] Field of Search ..... 210/380.1, 380.3; 494/50–56

[56] References Cited

U.S. PATENT DOCUMENTS

| | | | |
|---|---|---|---|
| Re. 11,440 | 9/1894 | Malmros . | |
| 136,485 | 3/1873 | Burchardt . | |
| 455,832 | 7/1891 | Muller . | |
| 535,306 | 3/1895 | Stewart . | |
| 560,633 | 5/1896 | Peck | 494/50 |
| 560,634 | 5/1896 | Peck | 494/50 |
| 581,354 | 4/1897 | Lapp . | |
| 807,056 | 12/1905 | Berrigan | 494/53 |
| 832,191 | 10/1906 | Holzer . | |
| 992,876 | 5/1911 | Jones . | |
| 1,212,996 | 1/1917 | Parker . | |
| 1,395,517 | 11/1921 | Peck . | |
| 1,614,357 | 1/1927 | Gamper . | |
| 2,184,598 | 12/1939 | Jahn | 233/2 |
| 2,435,623 | 2/1948 | Forsberg | 233/29 |
| 2,528,974 | 11/1950 | Ritsch | 233/7 |
| 2,612,314 | 9/1952 | Huelsdonik | 233/7 |
| 2,703,676 | 3/1955 | Goocla | 494/53 |
| 2,743,865 | 5/1956 | Graae | 233/7 |
| 2,862,658 | 12/1958 | Dahlgren | 233/7 |
| 3,098,820 | 7/1963 | Gooch | 233/7 |
| 3,145,173 | 8/1964 | Sharples | 233/20 |
| 3,172,851 | 3/1965 | Ambler | 233/7 |
| 3,221,879 | 12/1965 | Irving | 210/106 |
| 3,348,767 | 10/1967 | Ferney | 233/7 |
| 3,419,148 | 12/1968 | Niwa et al. | 210/213 |
| 3,494,472 | 2/1970 | Quetsch | 210/374 |
| 3,506,187 | 4/1970 | Kompert et al. | 233/7 |
| 3,520,473 | 7/1970 | Gilreath | 233/47 |
| 3,532,265 | 2/1970 | Baram | 233/20 |
| 3,534,902 | 10/1970 | Gilreath | 233/7 |
| 3,568,919 | 3/1971 | Nielsen | 233/7 |
| 3,568,920 | 3/1971 | Nielsen | 233/7 |
| 3,795,361 | 3/1974 | Lee | 233/7 |
| 3,885,734 | 5/1975 | Lee | 233/3 |
| 3,930,608 | 1/1976 | Baram | 233/3 |
| 4,299,353 | 11/1981 | Bruning et al. | 233/7 |
| 4,313,559 | 2/1982 | Ostkamp et al. | 233/7 |
| 4,334,647 | 6/1982 | Taylor | 233/7 |
| 4,362,620 | 12/1982 | High | 210/378 |
| 4,381,849 | 5/1983 | Conant | 494/43 |
| 4,617,010 | 10/1986 | Epper et al. | 494/52 |
| 4,784,633 | 11/1988 | Bruning et al. | 494/41 |
| 5,067,939 | 11/1991 | Shapiro | 494/53 |

FOREIGN PATENT DOCUMENTS

| | | | |
|---|---|---|---|
| 018761 | 7/1986 | European Pat. Off. . | |
| 3904151A1 | 8/1990 | Fed. Rep. of Germany . | |
| 3911320A1 | 10/1990 | Fed. Rep. of Germany . | |
| 571191 | 9/1991 | Fed. Rep. of Germany . | |
| 0902500 | 12/1944 | France . | |
| 1127063 | 5/1989 | Japan | 494/53 |
| 3-1076 | 3/1991 | Japan . | |
| 1059355 | 2/1967 | United Kingdom . | |

*Primary Examiner*—Harvey C. Hornsby
*Assistant Examiner*—Torrence R. Till
*Attorney, Agent, or Firm*—Seidel, Conda, Lavorgna & Monaco

[57] ABSTRACT

A decanter centrifuge including a discontinuous screw conveyor having flights only within the generally cylindrical portion of the centrifuge bowl. A restricting disc is provided adjacent to the heavy phase material discharge ports such that the restriction contacts the build-up of heavy phase within the portion of the bowl where the flights are discontinuous.

30 Claims, 6 Drawing Sheets

FIG. 4
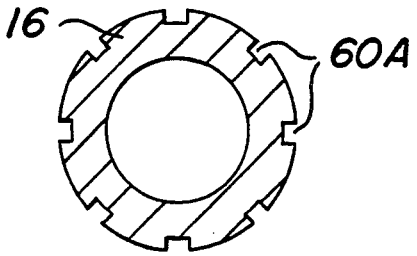
FIG. 5
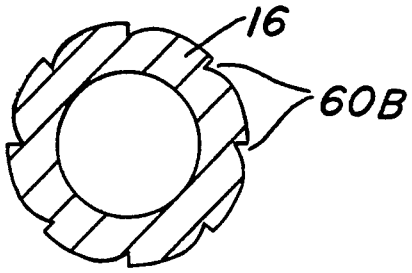
FIG. 6
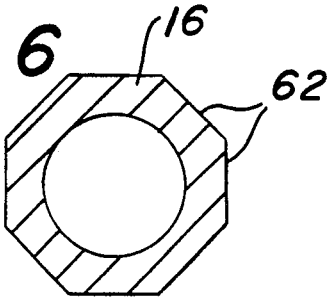
FIG. 7
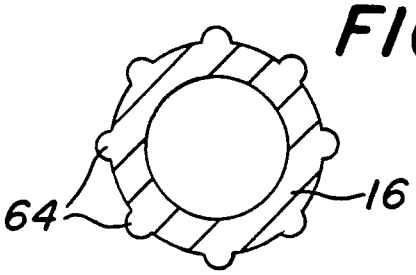
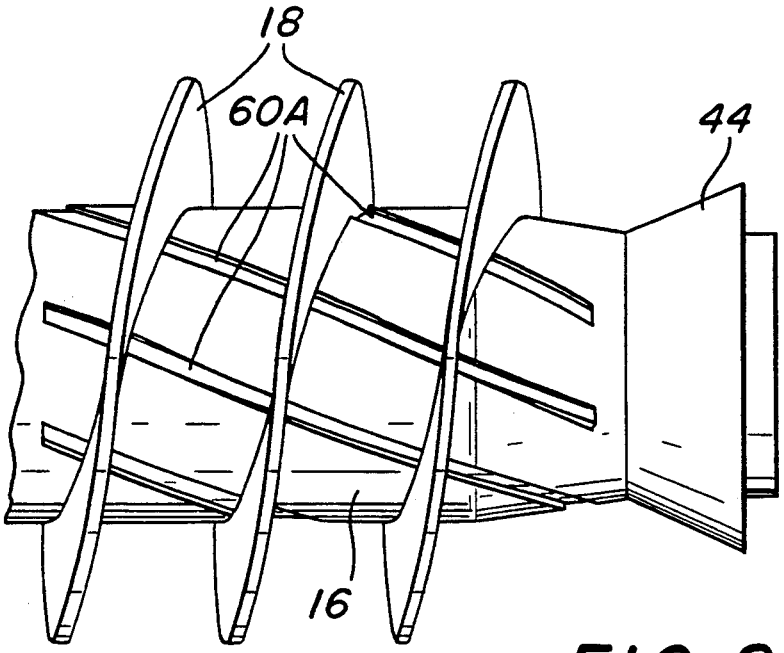
FIG. 8

FIG. 11
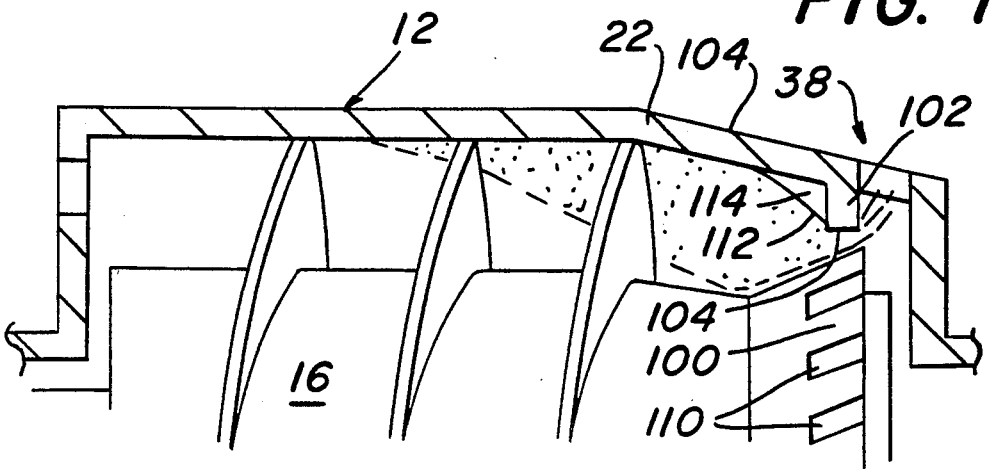
FIG. 12
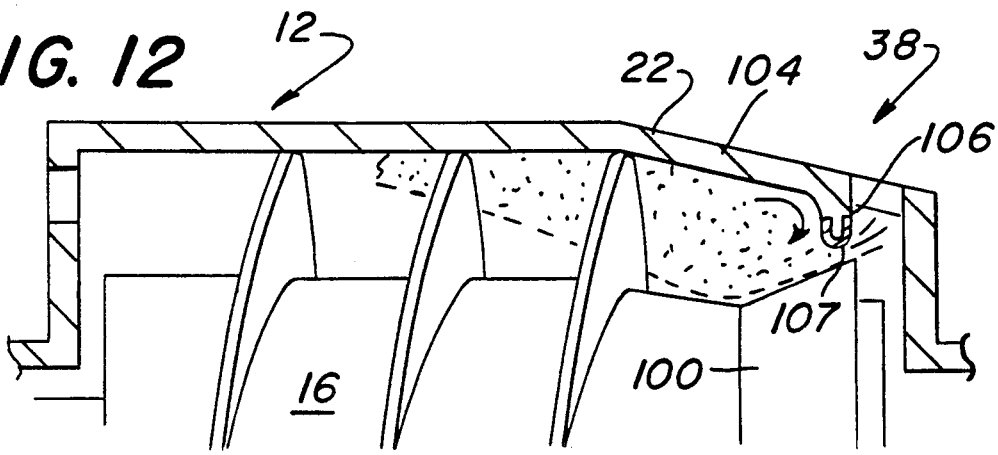
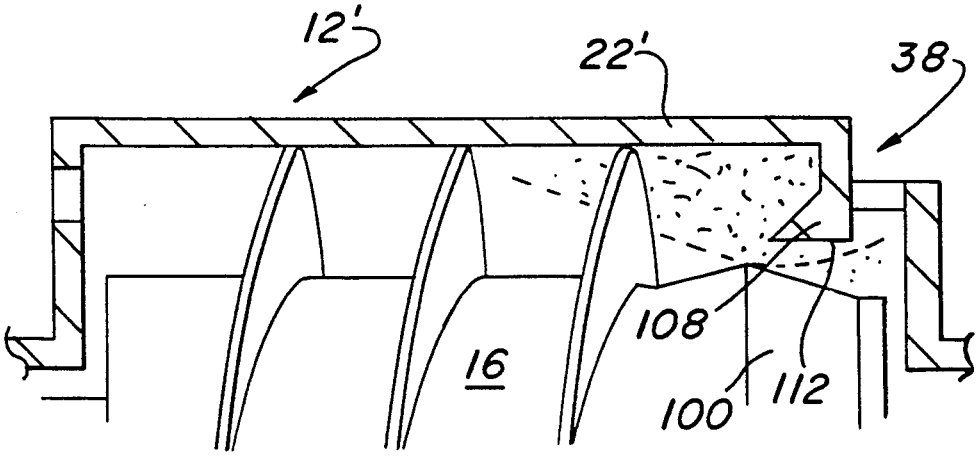
FIG. 13

DECANTER CENTRIFUGE HAVING DISCONTINUOUS FLIGHTS IN THE BEACH AREA

FIELD OF THE INVENTION

The present invention relates to an improved decanter centrifuge. Specifically the present invention relates to a decanter centrifuge wherein the flights of the conveyor discontinue within a portion of the length of the bowl, such that the separated heavy phase material is no longer conveyed by the differential rotation of the conveyor with respect to the bowl within that portion of the bowl, and wherein a restriction is formed at the heavy phase discharge end of the bowl.

BACKGROUND OF THE INVENTION

A decanter centrifuge generally includes a rotating bowl, typically having a cylindrical portion and a frusto-conical end portion. The rotation of the bowl creates a centrifugal force which separates a liquid feed mixture into its constituent parts. The feed mixture within the bowl forms a cylindrical pond, with a ring or layer of separated heavy material adjacent the inside of the bowl wall and a ring or layer of lighter material radially inward of the heavy material layer.

The terms "heavy phase" and "light phase" are employed hereinafter to describe materials which are separable from the feed mixture by the decanter centrifuge through the application of centrifugal force. The light phase material will usually be a liquid and the heavy phase material will usually be a mixture of solids and liquid. The liquid feed mixture introduced into the bowl generally has a specific concentration of suspended solids or other insoluble material therein. These "solids" are generally concentrated by the centrifugal force to form a heavy phase or mixture of varying concentration within the rotating bowl, including coarse solids, fine solids and liquid. Because of the varying degrees in density of the solids as well as the varying degrees of centrifugal force acting on those solids within the bowl, the concentration of the separated heavy phase may vary within the bowl. The concentration of the heavy materials that do not settle from the liquid material also varies.

A screw conveyor, the distinguishing feature of a decanter centrifuge, rotates inside the bowl at a slightly different speed from the bowl. The flights of the screw conveyor push the separated heavy phase along the inside of the bowl wall towards the conical end of the bowl. Discharge ports for the separated heavy phase are located at the small diameter of the conical bowl portion. The separated light phase liquid is discharged by flowing from the cylindrical pond through separate discharge ports. The light phase liquid discharge ports are located, typically, at the opposite end of the bowl from the heavy phase discharge ports.

Separation of the heavy phase materials from the feed mixture is a function of the residence time of the mixture in the bowl, a function of the feed rate, and the ability of the centrifuge to separately discharge the heavy and light phase materials. The purpose of the decanter centrifuge is to separately discharge a concentrated heavy phase and a clarified liquid. In order for the heavy phase to be discharged, it must be moved up the incline of the conical end portion of the bowl, called the beach, against the centrifugal force component acting in the opposite direction downward along the beach.

The separate discharge of heavy phase and light phase material from a decanter centrifuge has been the subject of a number of patents for decanter centrifuges. Typically, a decanter centrifuge operates with the heavy phase discharge port being radially inward with respect to the weir surface of the light phase discharge ports. This operation, known as a "positive dam" or "below spillover", requires that the heavy phase material be moved by the conveyor across a portion of the beach where there is no overlying liquid layer.

Ambler U.S. Pat. No. 3,172,851 describes the operation of a decanter centrifuge with the liquid discharge weirs set at a "negative dam" or "above spillover" position, i.e., at a position radially-inward of the weir surface of the heavy phase discharge ports. The Ambler-type operation takes advantage of the force of the liquid on the heavy phase along the entire length of the beach to help the conveyor move heavy phase material up the beach toward the heavy phase discharge ports. The relative radial difference between the weir surfaces is intended to be slight. The Ambler-type operation relies on the cohesive nature of the heavy phase material to form a dam that prevents the liquid head (the height of the liquid layer radially inward of or above the heavy phase discharge weir surface) from washing over the heavy phase weir surface.

Within the Ambler-type operation, the heavy phase layer in the conical end of the bowl is totally immersed in the liquid until the moment before discharge. Therefore, the heavy phase will be relatively wet. (In a "below spillover" type operation, the heavy phase emerges from the liquid on the beach and is subjected to a drying action prior to discharge.) However, the cohesive nature of the heavy phase material may be inconsistent. If a breakdown in the heavy phase dam formed at the heavy phase discharge weir occurs, a "washout" results. A washout is the result of the liquid head moving over the heavy phase discharge weir and, thus, a breakdown of the desired separate discharge of heavy and light phases. Moreover, the operation of a decanter centrifuge is generally required to be steady and continuous, that is, without constant operator assistance. If a washout occurs, substantial modification of the operation of the decanter centrifuge is required in order to rebuild the heavy phase dam at the discharge weir and to again achieve steady state operation. Moreover, in order to avoid a washout, constant supervision of the centrifuge may be required.

Lee U.S Pat. No. 3,795,361 also teaches the operation of a decanter centrifuge in an "above spillover" condition. The Lee decanter centrifuge includes an annular baffle mounted on the screw conveyor. The baffle, which may be made in a number of forms, such as a disc or a cone, extends radially outward from the conveyor hub to a distance where its peripheral edge is in a closely spaced relationship with the inside bowl wall. The outside diameter of the baffle penetrates into the outer, heavy phase layer to form a restricted passageway. The restricted passageway permits the underflow of only heavy phase material at the bowl wall, past the baffle, and into the conical end of the bowl. Thus, the baffle divides the bowl into a cylindrical separating zone, where the centrifugal force separates the heavy phase from the light phase liquid, and a discharge zone, where only heavy phase is present. The Lee decanter centrifuge creates a centrifugal pressure head within the separating zone. This pressure head is the result of the liquid weir being radially inward of the heavy phase discharge weir. This pressure head acts in cooperation with the baffle to provide a supplemental discharge force that assists the screw conveyor in discharging the heavy phase material. This supplemental force created in the separating zone is applied to the separated heavy phase, through the restricted passageway formed by the baffle, and into the discharge zone. The centrifugal pressure head applies a force that assists the conveyor in advancing the heavy phase material up the beach to the discharge ports.

Epper, et. al U.S Pat. No. 4,617,010 shows a decanter centrifuge and/or a nozzle-type centrifuge having a series of projections mounted on the bowl wall along a conical portion thereof so as to create a conveying action in addition to a shearing action on the heavy phase prior to reaching the discharge port. The shearing elements in Epper are formed to assist the discharge of the heavy phase solids up the beach toward the discharge port and, thus, replaces the flights of the conveyor. The Epper shearing elements are also shown in conjunction with a Lee-type baffle. However, the operation of the various Epper decanter centrifuges appears to be in a below spillover condition.

The typical application for a Lee type decanter centrifuge is on heavy phase materials which are considered difficult to convey. The physical characteristics of these difficult-to-convey heavy phase materials, being soft and slimy, are such that the screw conveyor alone cannot normally move them up the beach to the heavy phase discharge ports in a normal below spillover decanter centrifuge type operation. Moreover, these difficult-to-convey materials are contemplated to be of insufficient cohesive nature in order to create a dam at the heavy phase discharge weir for the creation of the Ambler-type operation.

Difficult-to-convey materials are typically found in the operation of a waste water treatment plant. A thickening type operation results in a concentration of the discharged heavy phase material between 3% to 10% solids by weight. As a comparison, a dewatering-type operation produces a heavy phase discharge which has a concentration in excess of 10% solids (by weight), such that the resulting heavy phase may be disposed of by trucking or incineration.

Often within the operation of a decanter centrifuge, chemicals are used to condition feed materials to assist settling and/or coagulation of the solids in the formation of the heavy phase. Such chemicals are typically known as polymers, polyelectrolytes or flocculents. In a dewatering type operation, polymers are almost always required. However, in a thickening type operation, chemicals may or may not be used depending on the type of centrifuge, the nature of the feed material, and the desired heavy phase output concentration. It should be noted that the nature of the heavy phase material varies greatly from application to application due to the specific processes under which the feed material has been placed. Moreover, the application of chemicals to the feed mixture results in a more easily conveyable heavy phase material.

BRIEF SUMMARY OF THE INVENTION

The present invention relates to a decanter centrifuge of the type typically including a cylindrical bowl mounted to rotate about its longitudinal axis and having a conical end portion. The decanter centrifuge of the present invention further includes heavy phase discharge ports within the conical end and liquid discharge ports positioned at the opposite end of the bowl. A helical screw conveyor is coaxially positioned within the bowl and extends along the inside length of the bowl. Although the invention may be applicable to other decanter centrifuge structures, reference to this typical structure will be made for purposes of explanation.

In the present invention, the conveyor flights are discontinuous within the conical end of the bowl. The conveyor is rotated at a relative speed with respect to the bowl to move the separated heavy phase along the inside surface of the bowl toward the conical end. Because of the discontinuation of the conveyor flights within the conical portion of the bowl, it is contemplated that the heavy phase material will build up along the beach and substantially fill the conical portion. Depending on the nature of the heavy phase material, the build-up may be great enough to form a pile which is radially inward of the heavy phase discharge ports. This condition will likely occur in a dewatering type operation, where the heavy phase is relatively easy-to-convey, having a firm, cohesive nature and having been treated by chemicals.

A disc is provided adjacent to the heavy phase discharge ports. This disc restricts the annular passageway between the beach and the hub of the screw conveyor directly adjacent to the heavy phase discharge ports. The restricting disc adjacent to the heavy phase discharge ports serves to maintain the build-up of heavy phase material and to prevent washouts.

It is contemplated that the decanter centrifuge of the present invention may operate in an above spillover condition with the liquid discharge weirs being radially inward of the heavy phase discharge weirs. This above spillover condition within the present invention serves to assist in discharging the heavy phase material through the restriction formed by the restricting disc and the beach adjacent to the heavy phase discharge ports. In this regard, the operation of the decanter centrifuge is similar to an Ambler-type operation. However, the dam at the discharge end of the bowl is substantially increased by the discontinuation of the conveyor flights in the beach area.

It is contemplated that the decanter centrifuge of the present invention operating in an above spillover condition will result in an increase in the overall dryness of the heavy phase cake being discharged. However, the nature and extent of the above spillover condition will depend on the heavy phase material and the overall operation of the centrifuge, including the application of chemicals. Other features and advantages of the invention are also contemplated.

BRIEF DESCRIPTION OF THE DRAWINGS

For purposes of illustrating the invention, there is shown in the drawings forms which are presently preferred; it being understood, however, that this invention is not limited to the precise arrangements and instrumentalities shown.

FIGS. 4–8 show variation of the conveyor hub portion of the centrifuge of the present invention.

FIGS. 11–13 shown still further variations of a restriction means for a decanter centrifuge as contemplated by the present invention.

DETAILED DESCRIPTION OF THE DRAWINGS

Figure 1:
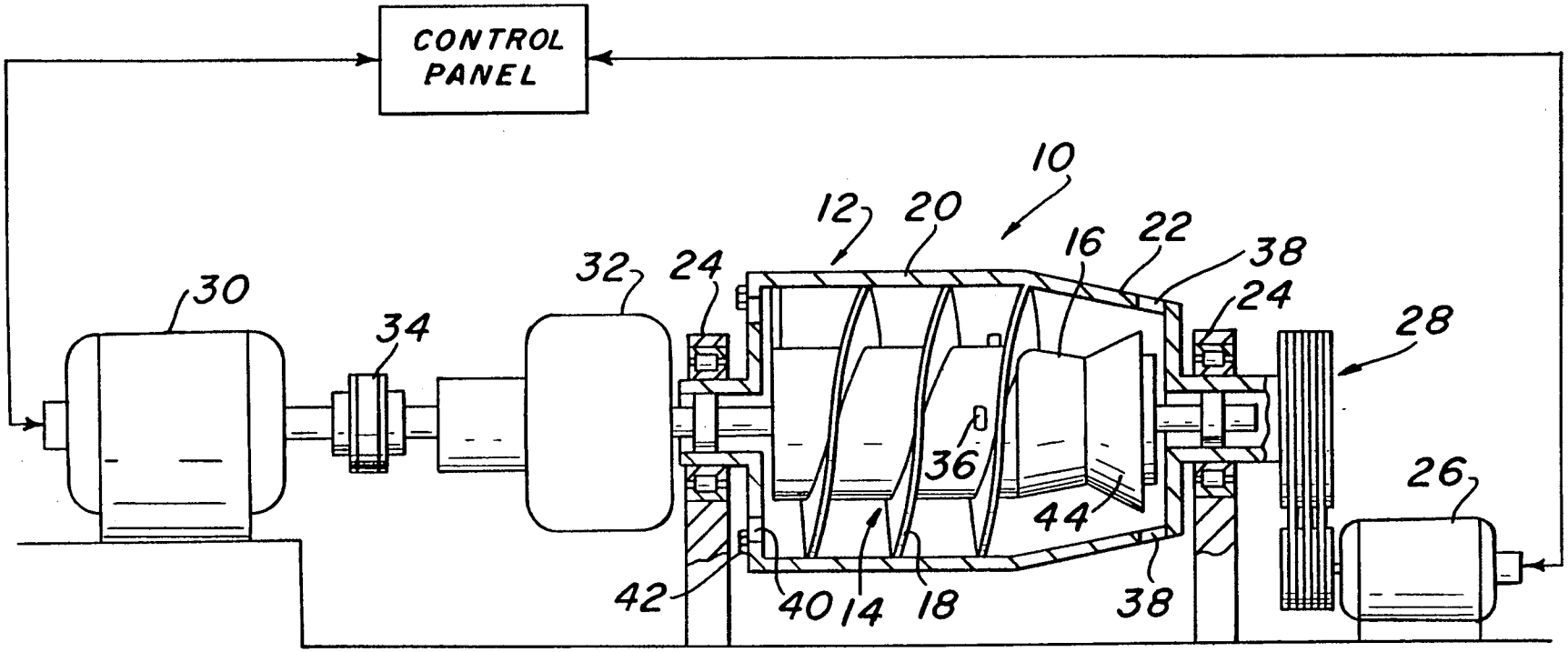
FIG. 1 is a cross-sectional view of a decanter centrifuge in accordance with the present invention.

In the drawings where like numerals indicate like elements, there is illustrated in FIG. 1 a decanter centrifuge generally referred to by the numeral 10. The decanter centrifuge 10 includes a solid imperforate bowl 12 and a coaxially mounted screw conveyor 14. The screw conveyor 14 includes a series of flights 18 mounted on a central hub 16. The bowl 12 includes a cylindrical portion 20 and a frusto-conical or angled portion 22. The bowl 12 is mounted for rotation about its central longitudinal axis and is supported at opposite ends by bearings 24. The bowl 12 is rotated by motor 26, through a belt and pulley system 28. The conveyor 14 is rotated by a second motor 30. The relative rotational speed of the conveyor 14 with respect to the bowl 12 is created through gear box 32 connected to second drive motor 30 via flexible coupling 34.

A feed mixture is introduced into the bowl 12 through feed nozzles 36. The centrifugal force created by the rotation of the bowl 12 causes a separation of the feed mixture into light and heavy phases (shown in FIGS. 2 and 3) in substantially concentric layers surrounding the axis of the bowl. The relative rotation of the screw conveyor 14 with respect to the bowl 12 results in the screw flights 18 moving the separated heavy phase material along the inside bowl wall toward the conical portion 22. At the heavy phase discharge end of the bowl, such as within the conical bowl portion 22, the flights 18 discontinue. This discontinuation of the flights creates a beach area which is relatively flightless.

At the top of the beach is provided a series of discharge ports 38 for the heavy phase material. At the opposite end of the bowl 12 is provided a series of light phase discharge ports 40. Weir plates 42 are attached to the bowl face adjacent to the light phase discharge ports 40 to define the radial surface of the light phase discharge weir. Weir plates 42 are radially adjustable such that the relative position of the light phase discharge to the heavy phase discharge is variable. In addition to the weir plates, it is anticipated that the centrifuge could be fitted with an inflatable dam on the liquid side of the bowl face, such as that described in commonly assigned application Ser. No. 07/711,479 filed Jun. 6, 1991. This '479 application is herein incorporated by reference. The inflatable dam type structure (not shown) could be utilized for the purpose of optimizing the pond level without requiring the stopping of the centrifuge to make adjustments.

Attached to the hub 16 of the conveyor 14 is a restricting disc 44. The restricting disc 44 is formed closely adjacent the heavy phase discharge ports 38 at the relatively smaller diameter of the beach. The amount of restriction formed by disc 44 will be dependent upon various operational conditions of the decanter centrifuge and the desires of the centrifuge designers. Moreover, the profile of the disc 44, which is tapered or angled toward the center of the decanter centrifuge 10, may also vary in order to achieve preferred operational conditions. Some of these variations will be discussed hereinbelow.

Figure 2:
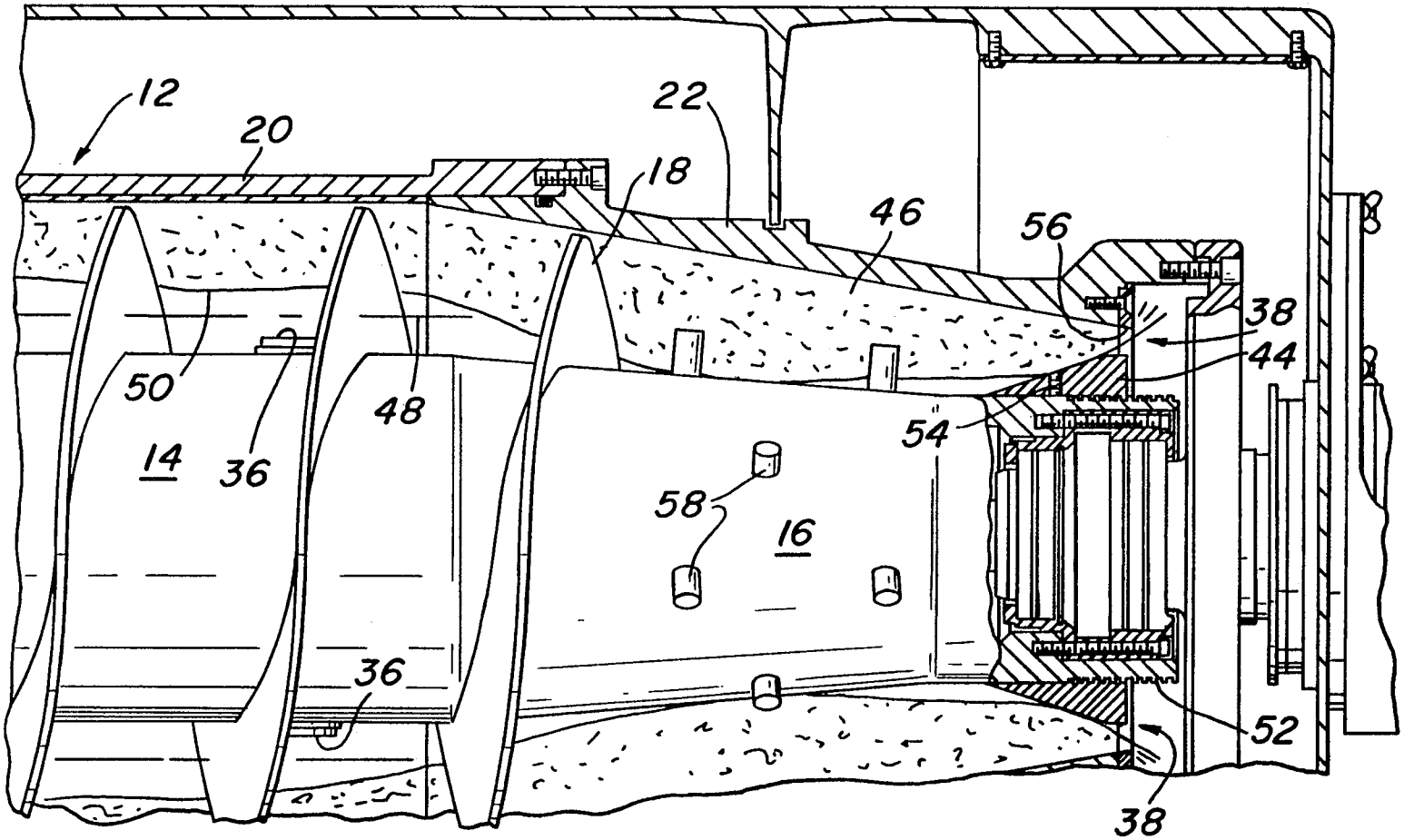
FIG. 2 is a partial cross-sectional view of the decanter centrifuge of FIG. 1 which illustrates a contemplated solids profile in accordance with the present invention.

In FIG. 2 there is illustrated in greater detail the decanter centrifuge 10 as generally shown in FIG. 1. FIG. 2 also illustrates what is believed to be a potential profile for the heavy phase layer 46 and the light phase layer 48 within the bowl 12. These profiles, however, are not necessarily accurate, but are artistic representation used as illustrations for purposes of understanding the operation of the present invention. In this regard, the demarcation line at interface 50 between the heavy phase material 46 and the light phase layer 48 is illustrated to be abrupt. It is contemplated that this interface 50 may be a transition zone wherein the concentration of heavy phase varies significantly. The nature and scope of interface 50 between the light phase layer 48 and the heavy phase 46 is generally understood in the art. Also, feed ports 36 generally introduce a feed mixture into the bowl 12 at a position adjacent the connection between the cylindrical portion 20 and the conical portion 22. Manifestly, due to the introduction of liquid feed material at this point, the general concentration of the "solids" within the heavy phase and the liquid light phase may greatly vary in this "feed zone".

In FIG. 2, the heavy phase layer 46 is shown as increasing in thickness as it approaches the conical portion 22 of the bowl 12. Because the flights 18 of conveyor 14 are discontinuous in the conical bowl portion 22, the heavy phase layer 46 builds up. This is a combination of the lack of further conveyance of the material along the beach and the continuous introduction of heavy phase material by the conveyor flights 18 from the cylindrical portion 20 into the conical portion 22 of the bowl 12. It has been found through testing that the build-up of heavy phase may approach and contact the hub 16 of the conveyor 14. As illustrated, the profile of the heavy phase material 46 includes a maximum that contacts the hub 16 forming a taper thereafter toward the heavy phase discharge ports 38.

The restricting disc 44 contacts the profile of heavy phase 46 as it approaches the discharge ports 38. Restricting disc 44, as illustrated in FIG. 2, is in the form of an annular ring which is attached to the hub 16 of the conveyor 14 by means of a screw thread 52. Set screws 54 may also be used to maintain the restricting disc 44 in its set position during rotation of the conveyor 14. Rotation of the restricting disc 44 on the hub 16 adjusts the axial position of the restricting disc with respect to the discharge openings 38.

Restricting disc 44 has a frusto-conical configuration with a straight tapered surface. In the embodiment shown in FIG. 3, the restricting disc 44' includes an arcuate tapered surface. These variations in the formation of the restricting disc 44 and 44' are contemplated to produce different profiles of the heavy phase material 46 at the discharge outlets 38 in the centrifuge bowl 12. It should be noted, however, that the restricting disc of the present invention may also take any form as desired, including an annular baffle. The restricting disc 44 may be integral with conveyor hub 16 or, if desired, may be supported from the bowl end face and out of contact with the conveyor hub 16.

Figure 3:
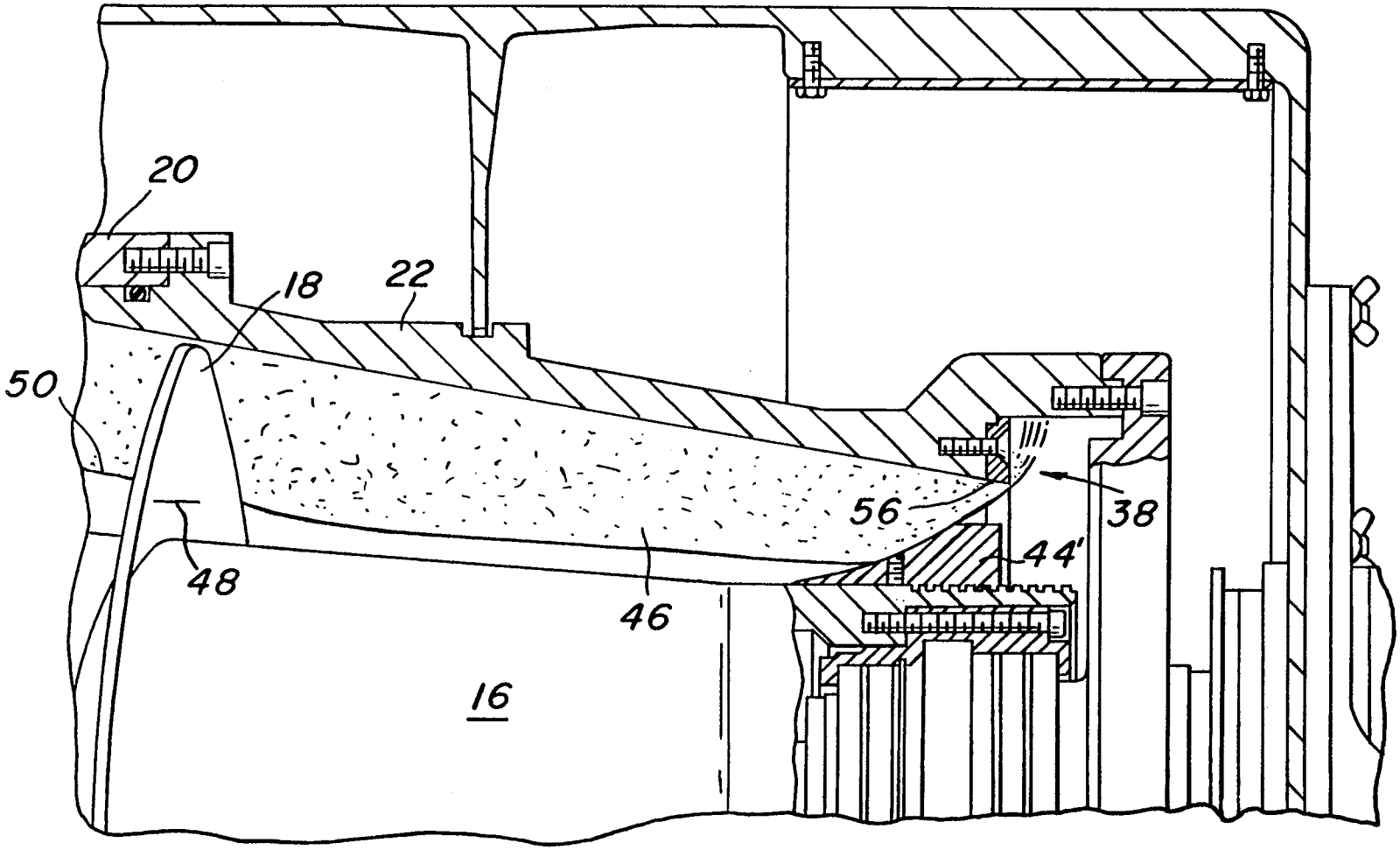
FIG. 3 shows a partial cross-sectional view of an alternate embodiment of the decanter centrifuge of the present invention.

As illustrated in FIGS. 2 and 3, the light phase layer 48 is positioned radially inward of the heavy phase discharge port weir surface 56. Manifestly, the large build-up of heavy phase material 46 serves as a solids dam for the head of light phase 48 positioned above weir surface 56. In this regard, an Ambler-type operation is contemplated. However, as expressed previously, the heavy phase build-up in the decanter centrifuge of the present invention is contemplated to be in excess of that in a typical Ambler-type operation. In the present invention the build-up may extend radially inward of the position of the light phase layer 48. Manifestly, not only is the hydraulic assistance toward discharge being provided by the head of liquid 48, but there is a transitional drying zone within the conical portion 22 of the bowl for the heavy phase build-up 46.

As described previously, the Lee operation includes an annular baffle for the passage of only the heavy phase material between the inside of the bowl wall and the outside of the baffle. Therefore, the separation of the heavy and light phase materials is discontinued when the heavy phase material passes under the baffle. Any separation of light phase that could occur after passing the baffle would still be discharged with the heavy phase from the heavy phase discharge ports, since the liquid has no way to return toward the light phase discharge ports. Although a Lee type baffle could be used with the present invention in certain conditions, such structure is not preferred. Thus, the present invention will take advantage of the additional length of the bowl that is made available for separation to occur. This feature of the invention also provides for additional residence time of the feed mixture in the bowl and thus improves separation of the phases.

In FIG. 2 there is illustrated a series of projections 58 extending from the bowl hub 16 in the flightless portion of the centrifuge 10. The projections 58 are provided to stir or shear the heavy phase material 46 in the conical portion of the bowl where the flights are not included in an attempt to release entrained liquid from the heavy phase material and aid in its rise to the inner surface of the heavy phase layer 46. Although projections of the type in Epper, et al. U.S. Pat. No. 4,617,010 may be provided, it is generally desired that the projections 58 of the present invention do not include a discharge assist in this conical portion 22 of the bowl 12. If the projections 58 were to include a significant conveying function as in this Epper patent, these structures would serve to reduce the profile of the heavy phase 46 in the conical end 22 of the bowl 12 and increase the possibility of a washout. In the present invention, it is the build-up of heavy phase that is contemplated to prevent a washout from occurring. It is also contemplated that modifications to the restricting disc may compensate for this variation in build-up, if the stirring elements are considered desirable. It is contemplated, however, that the restricting disc will contact the heavy phase build-up adjacent to the heavy phase discharge ports at the small diameter of the conical portion of the bowl.

It is also contemplated that the restricting disc 44 will cause the heavy phase material to be compressed axially as it approaches the discharge ports 38. This compression may allow for further separation of the liquid from the heavy phase. However, because the heavy phase is contemplated to be in contact with the conveyor hub 16, the liquid that may separate will possibly be blocked from returning back toward the cylindrical bowl portion 20 so as to be discharged from the light phase discharge ports 40.

As illustrated in FIGS. 4–8, in order to assist the separated liquid in returning toward the cylindrical bowl portion 20 so that it may be discharged with the light phase, the surface of the conveyor hub 16 in the flightless portion of the centrifuge may be provided with a series of guides. These guides include grooves 60A in FIGS. 4 and 8, grooves 60B in FIG. 5, flats 62 in FIG. 6, and raised ribs 64 in FIG. 7. These guide elements 60A, 60B, 62, and 64 on the outside surface of the conveyor hub 16 provide channels for the return of the separated light phase toward the cylindrical bowl portion 20.

As illustrated in FIG. 8, the guide elements, such as grooves 60A, are provided along the outside surface of the conveyor hub 16 and may extend into the area of the flights 18. In this flighted area, openings are provided in the conveyor flights 18 to permit the liquid to pass back further into the bowl 12 to the area of the feed ports 36. The grooves 60A as illustrated are spiralled along the surface of the conveyor hub 16 in a direction opposite of the spiral of the conveyor flights 18. This opposite spiral will further aid in the return of the liquid to the light phase in pond 48. However, the guide elements could be axial or spiralled in any manner as desired.

It is further contemplated that in order to compress the heavy phase in the area of the flightless bowl, the last turns of the conveyor flights 18 may be varied in pitch from the remaining portions of the conveyor 14. The variation of the pitch is contemplated to be either an increase or a decrease as the flights approach the heavy phase discharge end depending on the conditions of the feed material.

Figure 9:
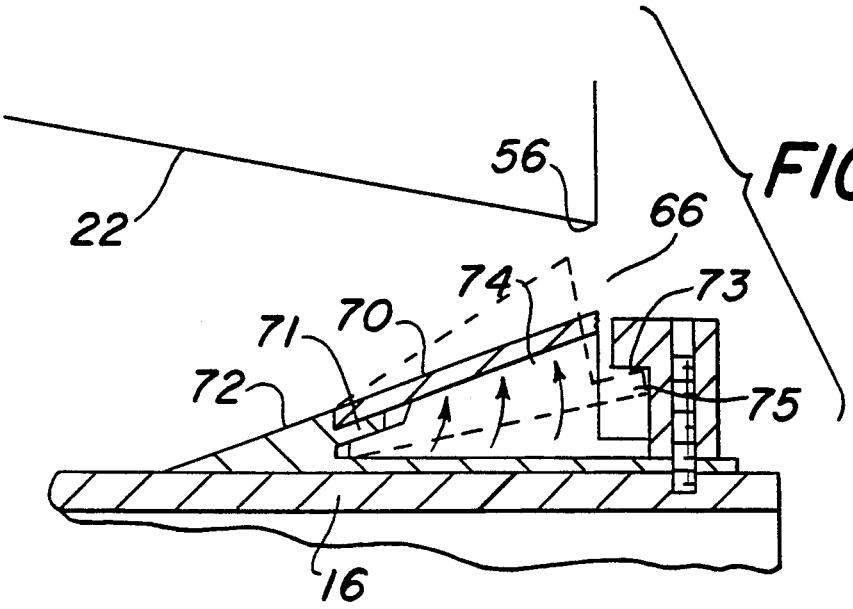
FIGS. 9 and 10 shown variation of the restricting disc portion of the present invention, including a variable restriction force.
Figure 10:
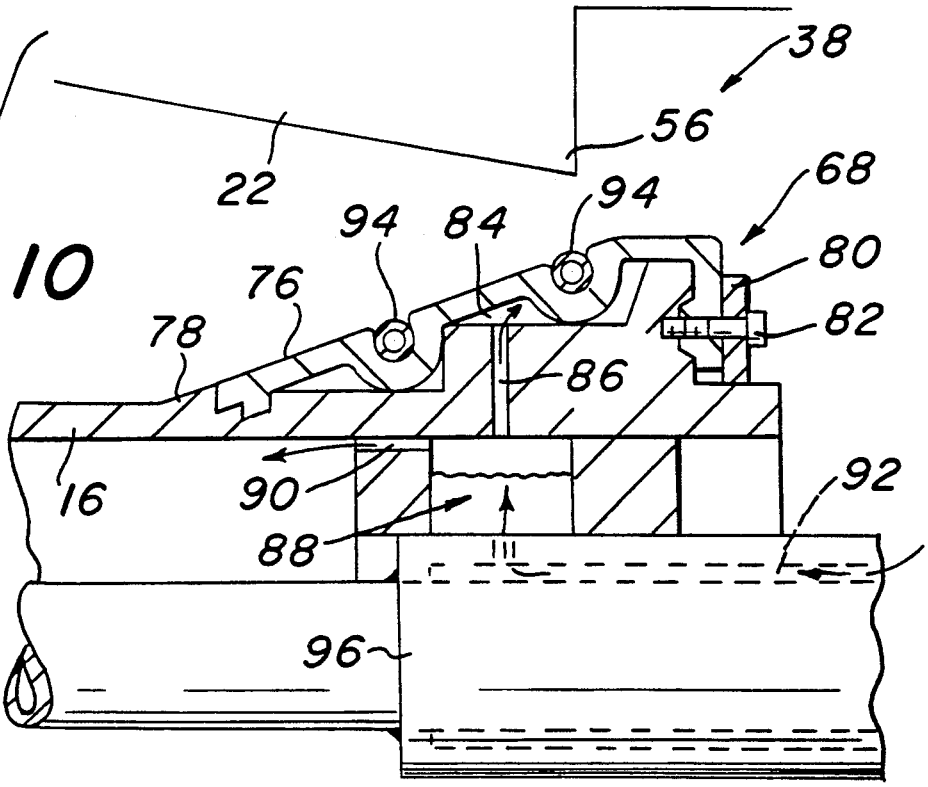

In FIGS. 9 and 10 there is illustrated further embodiments of a restricting disc portion of the present invention. The restricting discs 66 and 68, respectively, include means for adjusting the amount of restriction provided on the heavy phase adjacent the discharge ports 38. This adjustment of the restriction may be used to accommodate changes or variations in the feed material resulting in different or variable qualities of the heavy phase.

The embodiment of the restricting disc 66 in FIG. 9 includes a conical collar portion 70 attached to the mount 72 at one end and having a series of fingers 74 which extend from the inside surface of the collar 70 into contact with the mount 72, adjacent the conveyor hub 16. The collar 70 is contemplated to be made of a rubber or other resilient material. The fingers 74 create a force on the collar 70 due to their pivoting action about pivot 71. The movement of the fingers 74 is created by the centrifugal force of the rotation of the conveyor 14. The discharging action of the heavy phase material from the discharge ports 66 works against the outward movement of the fingers 74 and the collar 70. The maximum extension of the collar 70 is controlled by stop 73 which is engaged by tab 75 on the finger 74. Thus, the heavy phase discharge is restricted not only by the form of the restricting disc 66 but the resilience of the collar 70 and finger 74 combination. As the heavy phase is moved through the restriction, the compression force will be nearly constant as the collar 70 adjusts for changes in discharge rate of the heavy phase material.

The fixed restriction 44 as shown in the previously discussed figures provides an optimum profile for the heavy phase material in the bowl at only one discharge rate. The variable restriction of FIG. 9 provides a nearly constant profile for the heavy phase material for varying discharge rates.

In FIG. 10 there is shown a restricting disc 68 whereby the adjustment may be remotely controlled during operation of the centrifuge. The restricting disc 68 in this embodiment includes collar portion 76 which is bonded to the mount 78 at the small end and fixedly mounted at the large end by means of stop plate 80 and bolt 82. This mounting structure for the collar 76, which is preferably made of rubber or a resilient material, forms a cavity 84 adjacent the mount 78. A feed passageway 86 is provided in the mount 78 such that a control liquid may be fed into the cavity 84. The control liquid is used to vary the inflation of the collar 76 and thus the size of the restriction formed by disc 68. Passageway 86 communicates with a reservoir 88 formed on the inside surface of the mount 78. Control of the inflation of collar 76 is provided by a control liquid feed system, including a leak bushing 90 and feed supply 92. The leak bushing 90 is provided in reservoir 88 for exhaust of the control liquid. In order to assist in the deflation of the restricting disc 68, a series of coil springs or resilient bands 94 are provided in the outside surface of the collar 76. The bands 94 tend to resist inflation of the restricting disc 68 and counter the force of the control liquid head in the reservoir 88 and the centrifugal force. When the rate of feed from supply 92 into the reservoir 88 is decreased, the level of the control liquid in the reservoir 88 will be at a larger radius and the pressure in the feed passageway 86 will also decrease. The bands 94 in this situation will restrict the size of the disc 68 and return the system to an equilibrium state. At equilibrium, the rate into reservoir 88 is equal to the rate of bushing 90. Control of the size of the disc 68 can thus be made external of the operating centrifuge by the adjustment of the control liquid supply rate.

It should be noted that the mount 78 in FIG. 10 is shown formed as part of the conveyor hub 16 while the mount 72 in FIG. 9 is attached thereto in a manner similar to the embodiment shown in FIGS. 2 and 3. Also, the exhaust of control liquid through the leak bushing 90 in FIG. 10 is directed to a feed port (not shown) and into the centrifuge bowl 12. The control liquid feed supply 92 is directed into the reservoir 88 via a supply line within the feed pipe 96. Feed pipe 96 also serves to direct the feed mixture into the centrifuge bowl 12.

In FIGS. 11-13 there is shown still further embodiments of the present invention whereby the restriction at the heavy phase discharge ports 38 is provided by a combination of structures both on the bowl 12 and the conveyor hub 16. The advantage of these embodiments is that the interface 112 between the fixed heavy phase heel 114 and the moving heavy phase layer can seek its own shape depending on the properties of the heavy phase. In addition, the motion of the heavy phase moving layer over the heavy phase heel 114, instead of along the conical portion of the bowl, prevents wear of the bowl.

In FIG. 11 there is shown a restriction disc 100 similar in form to the embodiments shown in the prior figures. The restricting disc 100 includes a series of notches 110 on the outside surface thereof, facing the buildup of the heavy phase. These notches are intended to make the heavy phase material rotate with the disc, while shearing it, and to assist in driving the material through the restriction. Also included is a restricting projection 102 which is attached to the narrow end of the conical portion 22 of the bowl 12. Also illustrated is a second cylindrical bowl portion 104 which creates a flat beach directly adjacent the projection 102 at the top of the conical bowl portion 22. The restricting disc 100, projection 102 and flat beach portion 104, in combination and separately, restrict the flow of heavy phase from ports 38 and provide the desired buildup of heavy phase within the flightless bowl portion.

In the embodiment shown in FIG. 12, the projection 106 is formed adjacent the heavy phase discharge port 38 at the top of the beach. The projection 104 includes a rounded inside corner so as to assist in the flow of heavy phase up and over the projection and through the discharge ports 38. An inflatable projection 107, actuated in similar fashion to that described in commonly assigned U.S. application Ser. No. 07/711,479, filed Jun. 6, 1991 (which is herein incorporated by reference), may also be provided to control the restriction between the projection 107 and the cone 100 on the conveyor hub. This structure permits the restriction to vary during operation so as to maintain the desired heavy phase build-up with changing feed conditions.

In FIG. 13 there is shown a further variation of the projection 108 formed as part of the end of the bowl 12'. Bowl 12' is formed without the conical portion. Thus, the flightless portion 22' of the bowl 12' in this embodiment is provided with a projection 108 at one end of a cylindrical bowl 12'. The heavy phase material will assume a buildup adjacent the projection 108 and define a variable or natural beach for the further discharge of heavy phase material through the discharge ports 38. A restriction formed by the inner surface 112 of the projection 108 and surface 100 of the conveyor hub 16 assists in the formation of the desired buildup of the heavy phase material adjacent the discharge port 38.

The embodiments in which the heavy phase material assumes its own beach angle in the discharge zone should be distinguished from a normal, "flighted" conveyor. In the normal conveyor, the envelope formed by the bowl around the conveyor flights is fixed to a specific shape and angle. In the embodiments shown in FIGS. 1-10, the angle of the flightless beach is estimated for purposes of obtaining the desired results with a beach shape that is simple to manufacture. In the embodiments shown in FIGS. 11-13 herein, the process within the bowl determines its own beach shape. This shape is anticipated to be hyperbolic or elliptical in cross-section as formed by the heel. The beach shape is determined by centrifugal and conveying forces within the heavy phase. As properties of the discharging heavy phase material change, the shape of the beach will adjust to accommodate these changes.

The present invention may be embodied in other specific forms without departing from the spirit or essential attributes thereof and, accordingly, reference should be made to the appended claims, rather than to the foregoing specification, as indicating the scope of the invention.

We claim:

1. A decanter centrifuge for separating a liquid feed mixture into its respective components by forming light phase material and a heavy phase material and for separately discharging the two phases, the centrifuge comprising:

a bowl rotatable about its longitudinal axis, the bowl having discharge ports therein at opposite ends for the separate discharge of light and heavy phase materials;

a screw conveyor coaxially mounted within the bowl, the screw conveyor having a central hub and a series of screw flights projecting from the hub to a position adjacent the inside bowl wall, the screw flights extending along a portion cf the axial length of the bowl and being discontinuous in a second portion of the bowl adjacent the heavy phase discharge ports;

feed means for introducing liquid feed mixture into the rotating bowl, the rotation of the bowl subjecting the feed mixture to centrifugal force and causing a separation of the feed mixture into separate layers of heavy and light phase material;

means for rotating the bowl and the conveyor at a relative speed with respect to one another, such that the flights of the conveyor move the heavy phase layer toward end of the bowl having the heavy phase discharge ports therein and causing a build-up of heavy phase material within the discontinuous flight portion of the bowl; and restriction means adjacent to the heavy phase discharge ports on the bowl, the restriction means contacting the heavy phase material build-up in the bowl and serving to restrict the flow of heavy phase material from the inside of the bowl toward its discharge.

2. A decanter centrifuge as claimed in claim 1 wherein the bowl includes a cylindrical portion and a conical portion, the flights of the conveyor being discontinuous within the conical portion of the bowl and the heavy phase discharge ports being positioned in the small end of the conical portion.

3. A decanter centrifuge as claimed in claim 1 further comprising: a series of projections extending radially outwardly from the conveyor hub in the discontinuous flight portion of the conveyor, the projections penetrating into the heavy phase buildup in the bowl.

4. A decanter centrifuge as claimed in claim 1, 2, or 3 wherein the restriction means further comprises means for resiliently resisting the flow of heavy phase material from the bowl through the heavy phase discharge ports.

5. A decanter centrifuge as claimed in claim 4 wherein the resilient resisting means further comprises means for inflation of restriction means and means for controlling the amount of inflation during operation of the centrifuge.

6. A decanter centrifuge as claimed in claim 5 wherein the control means further comprises a reservoir portion for maintaining a head of control liquid therein, the head of the control liquid providing an inflation force to the inflation means.

7. A decanter centrifuge as claimed in claim 4 further comprising a collar means for contacting the buildup of heavy phase material in the bowl, a mount attached to the conveyor hub, the collar means secured to the mount, and the resilient resisting means forcing against the heavy phase and providing a resistance to the flow of heavy phase from the bowl through the heavy phase discharge ports.

8. A decanter centrifuge as claimed in claim 1, 2, or 3 wherein the conveyor hub further comprises guide means for directing flow of light phase material from the discontinuous flight portion of the bowl toward the light phase discharge ports.

9. A decanter centrifuge as claimed in claim 8 wherein the guide means comprises a series of grooves in the outside surface of the conveyor hub, the grooves forming a spiral in a direction opposite of the direction of the conveyor flights.

10. A decanter centrifuge as claimed in claim 8 wherein the guide means comprises a series of flats on the outside surface of the conveyor hub.

11. A decanter centrifuge as claimed in claim 8 wherein the guide means comprises a series of raised ribs on the outside surface of the conveyor hub.

12. A decanter centrifuge as claimed in claim 8 wherein the guide means is spiralled on the outside surface of the conveyor hub, the spiral being in a direction opposite of the conveyor flights.

13. A decanter centrifuge as claimed in claim 1 wherein the restriction means further comprises a frusto-conical tapered disc supported on the conveyor hub, the tapered disc having its large end positioned adjacent the heavy phase discharge ports within the bowl.

14. A decanter centrifuge as claimed in claim 13 wherein the tapered disc further comprises an arcuate surface for contacting the heavy phase buildup in the bowl, the arcuate surface initiating at the small end of the taper.

15. A decanter centrifuge as claimed in claim 1 wherein the restriction means further comprises a projection means adjacent the heavy phase discharge ports, the projection means extending radially inwardly from the bowl wall toward the conveyor hub and forming a discharge weir surface for the heavy phase material.

16. A decanter centrifuge as claimed in claim 15 wherein the restriction means further comprises a frusto-conical tapered disc oh the conveyor hub, the tapered disc having its large end positioned adjacent the heavy phase discharge ports within the bowl and forming a restricted passageway for the heavy phase material along with the projection means.

17. A decanter centrifuge as claimed in claim 15 or 16 wherein the bowl includes a cylindrical portion and a conical portion, the flights of the conveyor being discontinuous within the conical portion of the bowl, the heavy phase discharge ports and the projection means being positioned in the small end of the conical bowl portion.

18. A decanter centrifuge as claimed in claim 15, 16, or 17 wherein the projection means further comprises an inflatable means forming the weir surface of the projection means and adapted for radial adjustment with respect to the conveyor hub to adjust the size of the restriction.

19. A decanter centrifuge as claimed in claim 17 wherein the bowl further comprises a second cylindrical portion extending from the small end of the conical bowl portion to the heavy phase discharge ports, the second cylindrical portion having a diameter that is less than the diameter of the first mentioned cylindrical bowl portion.

20. A decanter centrifuge as claimed in claim 1, 2, 3, or 4 wherein the radial position of the light phase discharge ports is radially inward of the radial position of the heavy phase discharge ports.

21. A decanter centrifuge as claimed in claim 1 wherein the restriction means comprises a frusto-conical tapered disc supported on the conveyor hub adjacent the heavy phase discharge ports, the surface of the disc having a series of angled grooves therein.

22. An apparatus for separating the components of a liquid feed mixture into respective light and heavy phase materials and for separately discharging the two phases, the apparatus comprising:

a cylindrical bowl rotatable about its longitudinal axis, the bowl having a conical portion having discharge ports therein;

a screw conveyor coaxially mounted within the bowl and having a series of screw flights extending from a central hub to a position adjacent the inside bowl wall, the screw flights being continuous along a portion of the axial length of the bowl and being discontinuous in the area of the conical portion of the bowl;

feed means for introducing the liquid feed mixture into the rotating bowl such that the rotation of the bowl subjects the feed mixture to a centrifugal force, separating the feed mixture into separate layers of heavy and light phase material;

means for rotating the bowl and the conveyor at a relative speed with respect to one another, such that the flights of the screw conveyor move the heavy phase layer toward the conical end of the bowl and causing a build-up of heavy phase material within the discontinuous flight area of the bowl; and restriction means adjacent to the heavy phase discharge ports at the small end of the conical portion of the bowl, the restriction means contacting the heavy phase material build-up in the conical portion of the bowl and serving to restrict the flow of heavy phase material from the inside of the bowl toward its discharge.

23. An apparatus as claimed in claim 22 wherein the restricting means generally forms a frusto-conical tapered disc having its wide end positioned adjacent to the discharge ports within the conical bowl portion.

24. An apparatus as claimed in claim 22 wherein the tapered disc further comprises an arcuate surface for contacting the heavy phase buildup in the tapered portion of the bowl, the arcuate surface initiating at the narrow end of the taper and extending to a position adjacent the discharge ports within the conical bowl portion.

25. An apparatus as claimed in claims 21, 22 or 23 further comprising light phase discharge ports separate from the discharge ports within the conical bowl portion, the radial position of the light phase discharge ports being radially inward of the radial position of the discharge ports in the conical bowl portion.

26. A decanter centrifuge for separating a liquid feed mixture into its respective components by forming light phase material and a heavy phase material and for separately discharging the two phases, the centrifuge comprising:

a bowl rotatable about its longitudinal axis, the bowl having discharge ports therein at opposite ends for the separate discharge of light and heavy phase materials;

a screw conveyor coaxially mounted within the bowl, the screw conveyor having a central hub and a series of screw flights projecting from the hub to a position adjacent the inside bowl wall, the screw flights extending along a portion of the axial length of the bowl and being discontinuous in the area of the bowl adjacent the heavy phase discharge ports;

feed means for introducing liquid feed mixture into the rotating bowl, the rotation of the bowl subjecting the feed mixture to centrifugal force and causing a separation of the feed mixture into separate layers of heavy and light phase material; and means for rotating the bowl and the conveyor at a relative speed with respect to one another, such that the flights of the conveyor move the heavy phase layer toward end of the bowl having the heavy phase discharge ports therein and causing a build-up of heavy phase material within the discontinuous flight area of the bowl.

27. A decanter centrifuge as claimed in claim 26 wherein the bowl includes a cylindrical portion and a conical portion, the flights of the conveyor being discontinuous within the conical portion of the bowl and the heavy phase discharge ports being positioned in the small end of the conical portion.

28. A decanter centrifuge as claimed in claim 26 or 27 wherein the radial position of the light phase discharge ports is radially inward of the radial position of the heavy phase discharge ports.

29. A decanter centrifuge as claimed in claim 28 further comprising restriction means adjacent to the heavy phase discharge ports on the bowl, the restriction means contacting the heavy phase material build-up in the bowl and serving to restrict the flow of heavy phase material from the inside of the bowl toward its discharge.

30. A decanter centrifuge as claimed in claim 29 wherein the restriction means comprises a frusto-conical tapered disc supported on the conveyor hub adjacent the heavy phase discharge ports.

* * * * *